United States Patent [19]

Okuda

[11] Patent Number: 4,856,488

[45] Date of Patent: Aug. 15, 1989

[54] IGNITION SYSTEM FOR AN INTERNAL COMBUSTION ENGINE

[75] Inventor: Hiroshi Okuda, Himeji, Japan

[73] Assignee: Mitsubishi Denki Kabushiki Kaisha, Tokyo, Japan

[21] Appl. No.: 113,518

[22] Filed: Oct. 28, 1987

[30] Foreign Application Priority Data

Oct. 31, 1986 [JP] Japan ..... 61-261212

[51] Int. Cl.[4] ..... F02P 3/08

[52] U.S. Cl. ..... 123/599; 123/149 C

[58] Field of Search ..... 123/149 C, 418, 599, 123/602

[56] References Cited

U.S. PATENT DOCUMENTS 3,805,759 4/1974 Fitzner .

4,202,305 5/1980 Wolf ..... 123/599

4,558,683 12/1985 Okuda .

4,718,394 1/1988 Honjoh et al. ..... 123/599

*Primary Examiner*—Tony M. Argenbright

*Attorney, Agent, or Firm*—Burns, Doane, Swecker & Mathis

[57] ABSTRACT

An ignition system for an internal combustion engine of the invention, which is adapted to periodically charge a capacitor by using as a power source a magnetogenerator in association with the internal combustion engine and ignite the internal combustion engine by discharge from the capacitor and which is provided with a capacitor charged by a first half cycle in an output signal from a signal coil and a zero-cross detector for detecting the zero-cross point where the output signal of the signal coil transfers from a first half cycle to a latter half cycle, so that, among continuous one cycle waveforms of the signal coil, voltage at the first half cycle is charged at the capacitor, the capacitor discharging at the timing detected by the zero-cross detector and the discharge voltage is used as an ignition timing signal, whereby the ignition timing can be kept about constant without creating any malfunction caused by a noise signal and also regardless of variation in the number of revolution of the internal combustion engine.

4 Claims, 4 Drawing Sheets

IGNITION SYSTEM FOR AN INTERNAL COMBUSTION ENGINE

BACKGROUND OF THE INVENTION

1. Field of the Invention

The present invention relates to an ignition system for an internal combustion engine, which uses as a power source a magnetogenerator in association with the internal combustion engine and uses discharge voltage from a capacitor as an ignition timing signal.

2. Description of the Prior Art

An ignition system for an internal combustion engine, which uses as a power source a magnetogenerator in association with the internal combustion engine, repeats charge and discharge to and from a capacitor at every constant cycle period, and takes discharge voltage from the capacitor as an ignition timing signal, is well-known. It is important for such ignition system to eliminate a malfunction caused by signal noises and to fix the ignition timing from the start to the high speed area of the internal combustion engine.

In order to prevent the malfunction caused by noises from a signal circuit, an apparatus for by-passing needless signals (in Japanese Patent Laid-Open Gazette No. 60-6072 (1985)) and that to suppress fluctuation in the ignition timing caused by the number of revolution of the internal combustion engine (in Japanese Patent Publication No. 56-19469 (1981) have been proposed.

FIG. 1 is a circuit diagram of the ingnition system disclosed in the Japanese Patent Laid-Open Gazette No. 60-6072 (1985), in which a reference numeral 1 designates an ignition power coil mounted on a magnetogenerator and for generating AC power. A capacitor 3 charged by the ignition power coil 1 is connected thereto through a diode 2 and in series with an ignition coil 5 comprising the primary coil 6 subjected to be charged from the capacitor 3 and the secondary coil 7 outputting the secondary voltage, and an ignition plug 8 given output voltage from the secondary coil 7 to carry out spark discharge.

A reference numeral 16 in the same drawing, designates a signal coil mounted on the magnetogenerator to generate AC power, the signal coil 16 connecting to the gate of a silicon-controlled reclifier (to be hereinafter called the thyristor) and the collector of a transistor 52 through a series circuit of a diode 17 and resistance 51, the anode of thyristor 4 connecting with a node of the diode 2 and capacitor 3.

The ignition power coil 1 connects with the base of the transistor 52 through a parallel circuit of a power circuit 9 and a diode 55, the transistor 52 being subjected to base voltage from the power circuit 9 and applied between the emitter and the base with the negative wave of the ignition power coil 1 through the diode 55.

Furthermore, a series circuit of a diode 53 and resistance 54 for controlling the negative wave of the ignition power coil 1 is connected to a node of the ignition power coil 1, power circuit 9 and diode 55.

Next, explanation will be given on operation of the ignition system.

The positive wave output of the ignition power coil 1 charges the capacitor 3 through the diode 2 and is supplied to a constant voltage power circuit 9, which is given power to output constant voltage. The signal coil 16 is connected to the gate of thyristor 4 so as to be given the positive wave from the signal coil 16 through a diode 17 and resistance 51, but while the ignition power coil 1 is charging the capacitor 3 with the positive wave, the output of the constant voltage power circuit 9 keeps the transistor 52 on, so that the positive wave of the signal coil 16 is by-passed through the transistor 52.

When voltage of the ignition power coil 1 transfers to the negative wave form, a voltage drop of the resistance 54 of a current flowing through the diode 53 and resistance 54 is applied between the emitter and the base of the transistor 52 to turn the transistor off, the output of the signal coil 16 is applied to the gate of thyristor 4, which is on to deliver the charge of capacitor 3 to the primary coil 6 at the ignition coil 5, and the output voltage from the secondary coil 7 ignites an internal combustion engine.

While the capacitor 3 is being charged, the gate of thyristor 4 is by-passed and masked against noises so that, when the charging is completed to make the ignition power coil to have negative waveform, the noise mask is released and simultaneously ignition is performed. Hence, this ignition system is effective in the system which once ignites the engine per one output cycle of the ignition power coil 1.

The ignition system disclosed in the Japanese Patent Publication Gazette No. 56-19469 (1981) applies reverse bias voltage to an output of a signal coil to suppress spark advance caused by an increase in the output of signal coil during the high speed running, thereby obtaining an about constant ignition time period from the low speed running to the high speed running. Hence, this ignition system is effective in suppressing the spark advance during the high speed running.

An internal combustion engine for an outboard motor, as above-mentioned, is desired to be constant in the ignition timing from the start to the high speed stage. However, generated voltage from the signal coil mounted on the magnetogenerator has an angular width in waveform and a crest value grows as the number of revolution increases, whereby it is inevitable to cause some delay at the start area.

On the contrary, the method of applying the reverse bias voltage to the signal voltage as the ignition system disclosed in the Japanese Patent Publication Gazette No. 56-19469 (1981), is about constant in the ignition timing, but during the low speed running where the number of revolution varies, this ignition system is not stable in the ignition timing. In other words, since the capacitor is charged by the output of signal coil at the present cycle period and the charge voltage becomes reverse bias to an output of the signal coil at the next cycle period, when the number of revolution suddenly changes, the reverse bias voltage fluctuates. As a result, an excessive advance or lag in the ignition timing will occur.

The noise mask method as disclosed in the Japanese Patent Laid-Open Gazette No. 60-6072 (1985) ignites the engine simultaneously with the mask release by the negative waveform, whereby it is difficult to make constant the ignition timing, because the armature reaction of the ignition power coil causes a shift in waveform.

SUMMARY OF THE INVENTION

In order to solve the above problem, the present invention has been designed.

An object of the invention is to provide an ignition system for the internal combustion engine, which is so constructed that the ignition power coil charges the capacitor during the first half cycle period of the signal coil, the zero-cross point from which the first half of cycle period of the signal coil to the latter half of the same is detected, and the capacitor is adapted to discharge at this timing, whereby fluctuation in the ignition timing by the speed change of the internal combustion engine is prevented, the ignition timing can be kept about constant from the low speed range to the high speed range, and a malfunction following the signal noises is completely removable.

The above and further objects and features of the invention will more fully be apparent from the following detailed description with accompanying drawings.

DETAILED DESCRIPTION OF THE PREFERRED EMBODIMENTS

Next, an embodiment of an ignition system of an internal combustion engine of the invention will be described.

Figure 1:
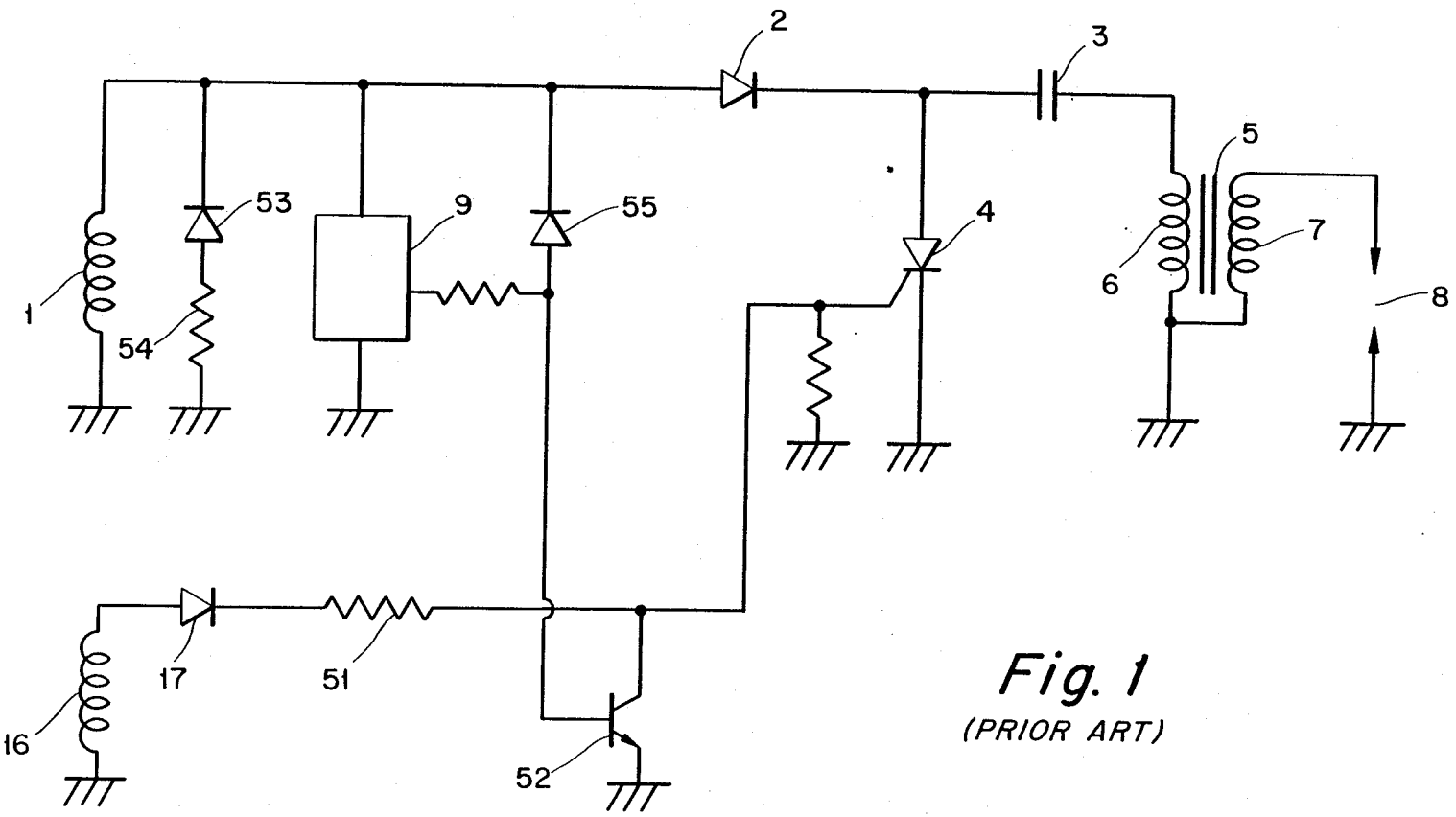
Fig. 1 (PRIOR ART)
FIG. 1 is a circuit diagram of an ignition system of the conventional internal combustion engine.
Figure 2:
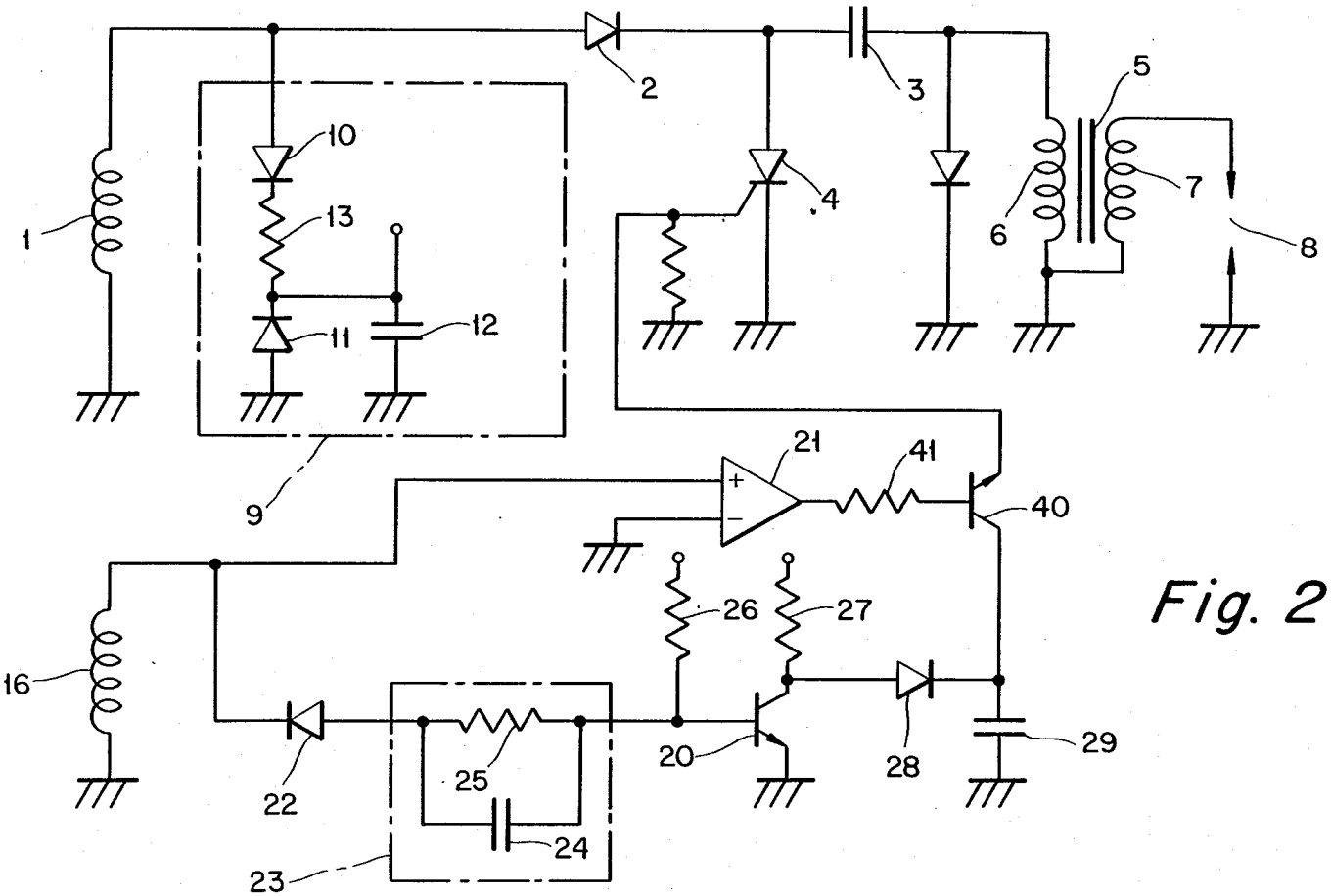
FIG. 2 is a circuit diagram of an ignition system for an internal combustion engine.

In FIG. 2, a reference numeral 1 designates an ignition power coil mounted on a magnetogenerator and for generating AC power, a capacitor 3 charged by the ignitio power coil 1 is connected thereto through a diode 2, and the capacitor 3 is connected in series with an ignition coil 5 comprising the primary and secondary coils 6 and 7 and with an ignition plug 8 which carries out spark discharge. The anode of an igniting thyristor 4 connects with the node of the diode 2 and capacitor 3, the thyristor 4 receiving at its gate at signal so as to be conductive at the ignition timing of the internal combustion engine, the charge of the capacitor 3 is delivered to the primary coil 6 at the ignition coil 5, and high voltage is induced in the secondary coil 7 to allow the ignition plug 8 to discharge, thereby igniting the internal combustion engine.

To the node of the ignition power coil 1 and diode 2 is connected a constant voltage circuit 9 receiving power from the ignition power coil 1 and generating constant voltage, the constant voltage circuit 9 comprising a diode 10, a constant voltage element 11, a capacitor 12 and a resistance 13.

Figure 3:
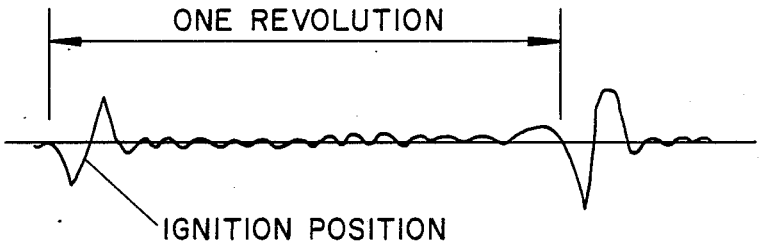
FIG. 3 is an illustration of operation of the ignition system of the invention.

In FIG. 2, a reference numeral 16 designates a signal coil mounted on a magnetogenerator and for generating AC power, which is connected to a noninverting input terminal (to be hereinafter referred to as the plus terminal) of a voltage comparator 21 and also to the base of a transistor 20 through a diode 22 and a peak detection circuit 23 of a parallel circuit comprising a diode 22, a capacitor 24 and a resistance 25. The signal coil 16, as shown in FIG. 3, generates positive and negative voltages so that the positive wave is applied to the plus terminal at a voltage comparator 21 and the negative wave, after being rectified by the diode 22, is applied to the base of the transistor 20 through the peak detection circuit 23.

The base of the transistor 20 is given voltage through a resistance 26, the collector of the same being given voltage through a load resistance 27. When the transistor 20 is off, a capacitor 29 is charged through the resistance 27 and diode 28.

The voltage comparator 21 is connected at its output terminal to the base of a transistor 40 through a resistance 41, the base being given the output from the voltage comparator 21, so that the transistor 40 is on-off by output voltage of the voltage comparator 21. The collector of transistor 40 is given voltage through the resistance 27 and diode 28, the emitter of the same connecting with the gate of the thyristor 4.

Figure 4:
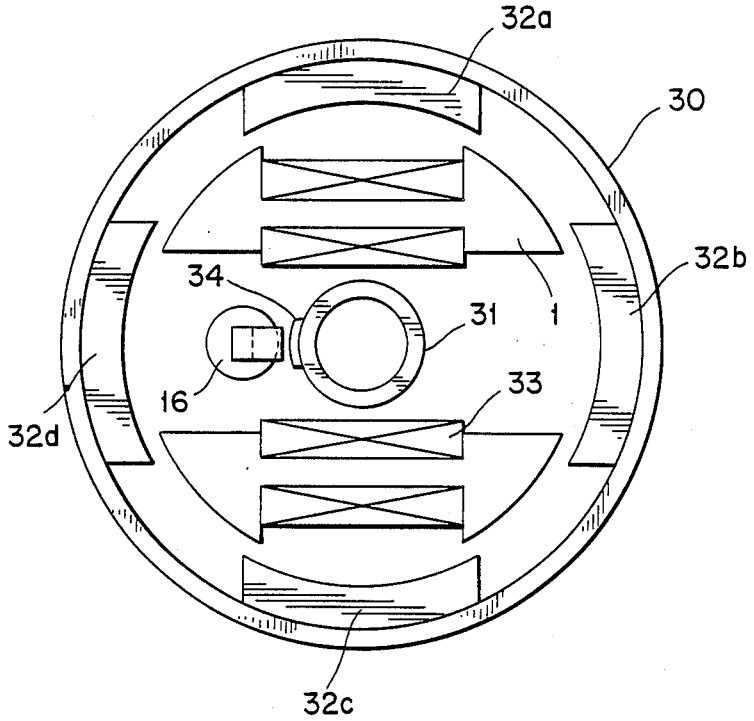
FIGS. 4 and 5 are structural views exemplary of an ignition power coil and a signal coil at the ignition system of the invention.
Figure 5:
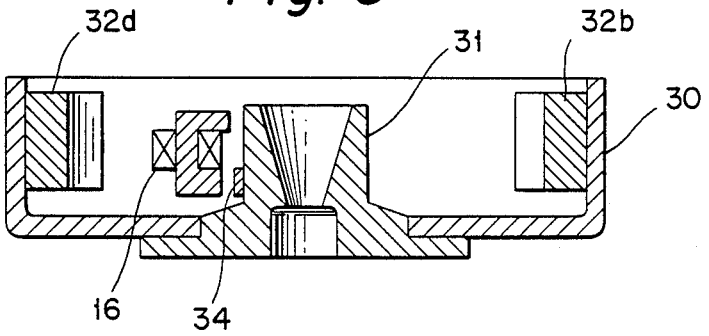

FIGS. 4 and 5 are structural views exemplary of a magnetogenerator having the ignition power coil 1 and signal coil 16 at the embodiment of the invention shown in FIG. 2. In FIGS. 4 and 5, a reference numeral 30 designates a cuplike-shaped rotor having at the axis of rotation thereof a boss 31. The rotor 30 is provided at the inner periphery of a cylinder thereof with a plurality of magnets 32*a*, 32*b*, 32*c* and 32*d*, the ignition power coil 1 and a power generating coil 33 being provided at the stator side and opposite to the plurality of magnets 32*a*, 32*b*, 32*c* and 32*d*.

A signal magnetic pole 34 is provided at the outer periphery of the boss 31, the stator is provided with the signal coil 16 opposite to the signal magnetic pole 34, and the signal coil 16 generates through the rotation of rotor 30 continuous signal voltage of negative and positive in one cycle.

Next, explanation will be given on operation of the ignition system of the invention.

Upon rotation of the magnetogenerator, the constant voltage power circuit 9 is subjected to the output from the ignition power coil 1 to generate constant voltage, and the signal coil 16 generates voltage in the negative direction at first as shown in FIG. 3, the voltage being applied to the base of transistor 20 via the diode 22 and peak detection circuit 23.

The transistor 20 is supplied with power supply voltage by the resistance 26 so as to be always on, but, when applied with negative voltage from the signal coil 16 through the peak detection circuit 23, becomes off, thereby charging the capacitor 29 through the resistance 27 and diode 28.

When the rotation of engine advances to the point where the voltage of signal coil 16 transfers from negative to positive, in brief, to the zero-cross point, (+) terminal voltage becomes higher than (−) terminal voltage at the voltage comparator 21, so that the output from the voltage comparator 21 charges to be at a high level and is given to the base of the transistor 40 through a resistance 41, whereby the transistor 40 is on.

When the transistor 40 is on, the charging voltage of capacitor 29 is applied to the gate of thyristor 4 through the transistor 40, so that the thyristor 4 is on to deliver the charge of the capacitor 3 to the primary coil 6 at the ignition coil 5, thereby igniting the internal combustion engine.

The capacitor 29, after complete discharge through the transistor 40, the thyristor 4, is zero (V) in terminal voltage and is kept zero (V) until the transistor 20 is off again. During the time period when the terminal voltage of capacitor 29 is kept zero (V), even when the transistor 40 is on, the gate of thyristor 4 is applied with no voltage, thereby enabling the ingnition in error by noises to be prevented.

The peak detection circuit 23 is CR-bias so that the capacitor is charged by output voltage of the signal coil 16 and discharged at the regular time constant to thereby gradually lower voltage. However, the time constant is so set tht the next signal enters the circuit before the voltage sufficiently drops, whereby the next signal is adapted to pass in the vicinity of the peak, in which noise will not be passed by the voltage charged in the capacitor.

Figure 6:
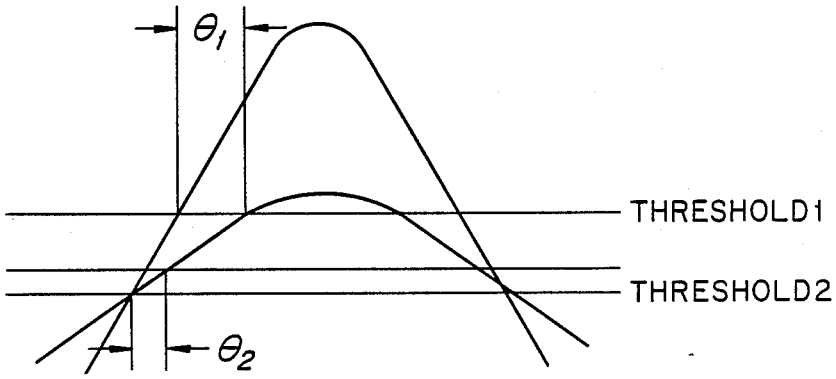
FIG. 6 is an illustration of operation of the ignition system for the internal combustion engine.

The zero-cross point ignition is characterized in that, as shown in FIG. 6, when a threshold of the gate is large, the signal waveform causes a shift $\theta_1$ in ignition position between the low voltage of signal coil during the low speed running and the high voltage of the same during the high speed running. As shown by $\theta_2$ in FIG. 6, the ignition position is less shifted as it approaches the zero-cross point, so that a stable ignition position is obtained to the low speed area, thereby enabling stabilization of the performance of internal combustion engine. The zero-cross position of the signal is decided by the mechanical positions of a signal magnet and the signal coil and not affected by the number of revolution, thereby stabilizing the ignition timing period even when the rotation largely fluctuates.

Generally, when the zero-cross is adopted, ignition in error by noise voltage generated in the signal coil is problematical, however, in the present invention, unless the first half cycle of the signal is created, the capacitor for triggering the thyristor is not charged, thereby enabling the zero-cross ignition.

The signal coil 16, when provided in the magnetogenerator as shown in FIGS. 4 and 5, is affected by the magnet and the armature action of the generating coil so as to generate various noise voltages as shown in FIG. 3, whereby the zero-cross point ignition is impossible. The present invention, however, enables the zero-cross point ignition, whereby the stability of the internal combustion engine can largely be improved.

As seen from the above, the ignition system of the internal combustion engine of the invention is adapted to charge the capacitor for triggering the thyristor at the first half cycle of the signal coil so that when voltage thereof is transferred from the first half cycle to the latter half cycle, the capacitor discharges toward the gate of thyristor, thereby triggering the thyristor. Hence, the ignition system of the invention is free from a malfunction caused by the noise signal and can keep about constant the ignition timing regardless of variation in the number of revolutions, thereby enabling the stability of the internal combustion engine to be improved.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An ignition system for an internal combustion engine which periodically repeats charge and discharge of a capacitor on the basis of an output signal from a signal coil, by using as a power source a magnetogenerator in association with said internal combustion engine, thereby igniting said internal combustion engine, comprising:

a signal coil which generates an AC signal of one cycle for the time period corresponding to a predetermined crank angle range of said internal combustion engine, a charge circuit for charging said capacitor during a first half cycle in a the output signal from said signal coil, a zero-cross detectio circuit for detecting that the output signal from said signal coil reaches the zero-cross point when transferring from the first half cycle to the latter half cycle, a discharge circuit which allows said capacitor to discharge on the basis of an output signal from said zerocross detection circuit so as to use discharge voltage from said capacitor as an ignition timing signal for said internal combustion engine, and an ignition circuit which receives the discharge from said capacitor to thereby ignite said internal combustion engine.

2. An ignition system for an internal combustion engine as set forth in claim 1, wherein said ignition circuit has a silicon-controlled rectifier which uses the output from said discharge circuit as a trigger signal.

3. An ignition system for an internal combustion engine as set forth in claim 2, wherein said discharge circuit has a transistor which outputs said trigger signal.

4. An ignition system for an internal combustion engine as set forth in claim 1, wherein said charge circuit has a parallel circuit of resistance and a bias capacitor which periodically repeats charge and discharge on the basis of the output signal from said signal coil so as to detect the peak position of the first half cycle of the output from said signal coil, and charges said capacitor at the detected peak position.

* * * * *